US008882500B2

(12) United States Patent
Fröjdman et al.

(10) Patent No.: US 8,882,500 B2
(45) Date of Patent: Nov. 11, 2014

(54) INTEGRATED DENTAL CARE APPARATUS

(75) Inventors: Jan Fröjdman, Helsinki (FI); Arto Virta, Helsinki (FI); Timo Müller, Helsinki (FI); Arto Huotari, Helsinki (FI)

(73) Assignee: Planmeca Oy, Helsinki (FI)

( * ) Notice: Subject to any disclaimer, the term of this patent is extended or adjusted under 35 U.S.C. 154(b) by 1039 days.

(21) Appl. No.: 12/312,681

(22) PCT Filed: Nov. 20, 2007

(86) PCT No.: PCT/EP2007/062566
§ 371 (c)(1),
(2), (4) Date: Dec. 10, 2009

(87) PCT Pub. No.: WO2008/061979
PCT Pub. Date: May 29, 2008

(65) Prior Publication Data

US 2010/0112513 A1 May 6, 2010

(30) Foreign Application Priority Data

Nov. 21, 2006 (FI) ..... 20061024
Nov. 22, 2006 (FI) ..... 20061029

(51) Int. Cl.
*A61G 15/00* (2006.01)
*A61G 15/14* (2006.01)

(52) U.S. Cl.
CPC ..... *A61G 15/14* (2013.01); *A61G 15/00* (2013.01)
USPC ..... 433/33; 297/170; 297/217.1; 297/344.21

(58) Field of Classification Search
CPC ..... A61G 15/00; A61G 15/14; A61G 15/06; A61G 15/10
USPC ..... 433/33
See application file for complete search history.

(56) References Cited

U.S. PATENT DOCUMENTS

| | | | | |
|---|---|---|---|---|
| 3,311,411 | A | 3/1967 | Page et al. | |
| 3,524,676 | A | 8/1970 | Cocherell et al. | |
| 3,821,852 | A * | 7/1974 | Kato | 433/29 |
| 3,823,475 | A * | 7/1974 | Heubeck | 433/33 |
| 3,982,322 | A * | 9/1976 | Fleer | 433/28 |

(Continued)

FOREIGN PATENT DOCUMENTS

| | | |
|---|---|---|
| EP | 1 287 783 A2 | 8/2002 |
| EP | 1287783 A2 * | 3/2003 |

(Continued)

OTHER PUBLICATIONS

International Search Report of PCT/EP2007/062566 mailed May 6, 2008.

*Primary Examiner* — Cris L Rodriguez
*Assistant Examiner* — Mirayda A Aponte
(74) *Attorney, Agent, or Firm* — Juan Carlos A. Marquez; Bacon & Thomas PLLC

(57) ABSTRACT

An integrated dental care apparatus includes a patient chair and a dental care unit. The dental care unit is mounted on a floor while the dental care unit and the patient chair are structurally connected by a structure which supports the patient chair. Both the dental care unit and the patient chair have means for enabling them to be turned in relation to a vertical axis.

27 Claims, 9 Drawing Sheets

(56) References Cited

U.S. PATENT DOCUMENTS

| | | | | |
|---|---|---|---|---|
| 3,986,263 | A | 10/1976 | Borgelt et al. | |
| 4,311,461 | A * | 1/1982 | Hotta et al. | 432/33 |
| 4,427,382 | A * | 1/1984 | Hoffmeister et al. | 433/79 |
| 4,500,134 | A | 2/1985 | Kaneko et al. | |
| 5,348,472 | A | 9/1994 | Joeckel et al. | |
| 6,406,294 | B1 | 6/2002 | Bell | |
| 2003/0042772 | A1 | 3/2003 | Park | |
| 2005/0127724 | A1 * | 6/2005 | Irwin et al. | 297/188.01 |
| 2006/0046226 | A1 | 3/2006 | Bergler et al. | |
| 2010/0227292 | A1 * | 9/2010 | Benfield | 433/33 |

FOREIGN PATENT DOCUMENTS

| | | | |
|---|---|---|---|
| EP | 1 541 110 | A2 | 12/2004 |
| GB | 2 300 804 | A | 11/1996 |
| JP | 10-258071 | | 9/1998 |
| JP | 2000-316921 | A | 11/2000 |
| JP | 2003-235876 | | 8/2003 |
| JP | 2005-169093 | A | 6/2005 |
| WO | WO 9631184 | A1 | 10/1996 |
| WO | WO 02/53080 AI | | 1/2002 |
| WO | WO 2006003143 | A1 | 1/2006 |

* cited by examiner

INTEGRATED DENTAL CARE APPARATUS

FIELD OF THE INVENTION

The present invention relates to an integrated dental care apparatus which comprises at least a patient chair and a dental care unit and to which is structurally connected at least one of the following: a spittoon arrangement comprising a water tap and possibly a cup stand, an arm for dentist's instruments, an arm for an assistant's instrument unit, an arm connected to a suction system of the integrated dental care apparatus, an arm for a display screen, an arm for an operation lamp, an arm for a tray, an arm for some other device or implement used in a dental care environment, a connector structure for any device or implement used in a dental care environment, whether mentioned above or not.

BACKGROUND OF THE INVENTION

In prior art, dental care units have been implemented as different constructions for different cultures amongst dentists, among other things. The dental care unit in itself is an apparatus used in connection with dental work, one essential and traditional function of which is to properly supply the dental instruments used by the dentist with the physical quantities required for their operation, such as operating power (e.g. electricity or pneumatic air) and/or water. In this context, and as evident to any person involved with dentistry, by the term dental care unit is thus meant a physical entity having a cover enclosing means for such a supply function at least. In connection with dental work, it is often also necessary to use instruments for removing blood, spit, tartar pieces etc. from the patient's mouth by suction. To allow the instruments to be kept at hand, the dental care unit is typically provided with various holders and/or arms. The dental care unit may even have several arms attached to it, for facilities such as an operating light and today e.g. a display screen. In some solutions, the patient chair is also integrated with the dental care unit to form a single apparatus. To be able to serve clients in regions differing in respect of the culture of dental care and also to respond to dentists' individual needs and practices regarding e.g. the way in which the dentist wishes the instruments to be available in connection with a dental care operation, manufacturers may have to keep numerous different apparatus versions in production.

One solution to reduce the number of different versions is to realize the apparatus as enabling realization of different configurations in order that the same basic construction can be utilized to meet at least two different client needs. As dental care units generally require connections for e.g. pneumatic air, suction and drainage, and often also for an incoming water network and electricity, such connections are typically built in the treatment room as permanent fittings by providing the required lines and connections in connection with this permanent installation.

A special category among dentists is the left-handed dentists. Particularly as dentists today typically work from one side of the patient lowered to a lying position, it is typically more natural for a left-handed dentist to work from a different side of the patient than the right-handed dentist prefers.

The prior art includes integrated dental care apparatuses implemented as allowing shifting even between the left/right-handed working. There is e.g. a prior-art arrangement in which the patient chair is fixed to the floor and the lines required for the instruments and other devices intended to be used via the dental care unit are passed thereto through the structures of the patient chair, and in which the dental care unit is connected to the chair by mounting it at an end of an arm part, which is arranged turnable with respect to a vertical axis so that the dental care unit can be turned from a first side of the patient chair to its second side. Although these arrangements do improve the situation in view of use of the apparatus from either side of the patient chair, yet the outcome of this solution as such is not symmetry in view of all conceivable parts of the integrated dental care apparatus.

On the other hand, the construction as described above comprises a basic structure wherein the patient chair is mounted on the floor. In many dentists' opinion, however, absolutely more ergonomic are integrated dental care apparatuses in which the patient chair is not fixed to the floor but in which the chair raising mechanism is arranged e.g. in connection with the dental care unit. A possibility provided by a basic structure like this is that the patient chair can be implemented as a relatively thin structure, making it possible to provide under the chair a space sufficient to allow the dentist to work in a sitting position even with his/her knees under the patient chair. Integration of patient chair and dental care unit provides a possibility to reduce the number of components needed in the apparatus.

Further, in addition to the patient chair, the dental care unit or the apparatus formed thereof often being arranged in the dental treatment room as a permanent installation, the dental treatment space is typically also provided with other fixed structures, such as shelves or e.g. a dental x-ray device mounted on a wall. Typically, the permanently installed solutions do not provide much possibilities for e.g. changing the patient's position on the treatment chair relative to the fixed structures in the treatment space, any more than for e.g. changing the dentist's or assistant's working location relative to these structures, or relative to other structures that may be comprised in the integrated dental care apparatus. Even more broadly speaking, considering many integrated dental care apparatuses in which several functionalities are integrated in the same construction, in many cases placement of different parts of the apparatus and the possibilities of adjusting their position leave room for improvement e.g. from the point of view of ergonomic working and the special requirements imposed by variable practice spaces.

BRIEF DESCRIPTION OF THE INVENTION

The object of the current invention is to provide a new concept for an integrated dental care apparatus, a concept which in itself and in its preferred embodiments enhances variability of the apparatus to meet different needs of different dental treatment rooms, especially in a way that permits better attendance to dentists' individual needs. The aim is still to retain the basic construction known in itself, wherein the patient chair is not arranged to be mounted on the floor but wherein it is arranged to be supported by other structures of an integrated dental care apparatus. A specific objective is additionally to enable the construction to be implemented in a manner that allows the apparatus to be arranged to be symmetric, preferably in respect of all its parts and properties visible to the user, so that all parts of the apparatus can be positioned in the same way on either side of the patient chair, and that the instruments and other devices connectable to it can be used in the same way from either side of the patient chair.

BRIEF DESCRIPTION OF THE FIGURES

In the following, these and some other objectives of the invention and some of its preferred embodiments will be described in greater detail by also referring to the attached drawings, wherein.

DETAILED DESCRIPTION OF THE INVENTION

Figure 1:
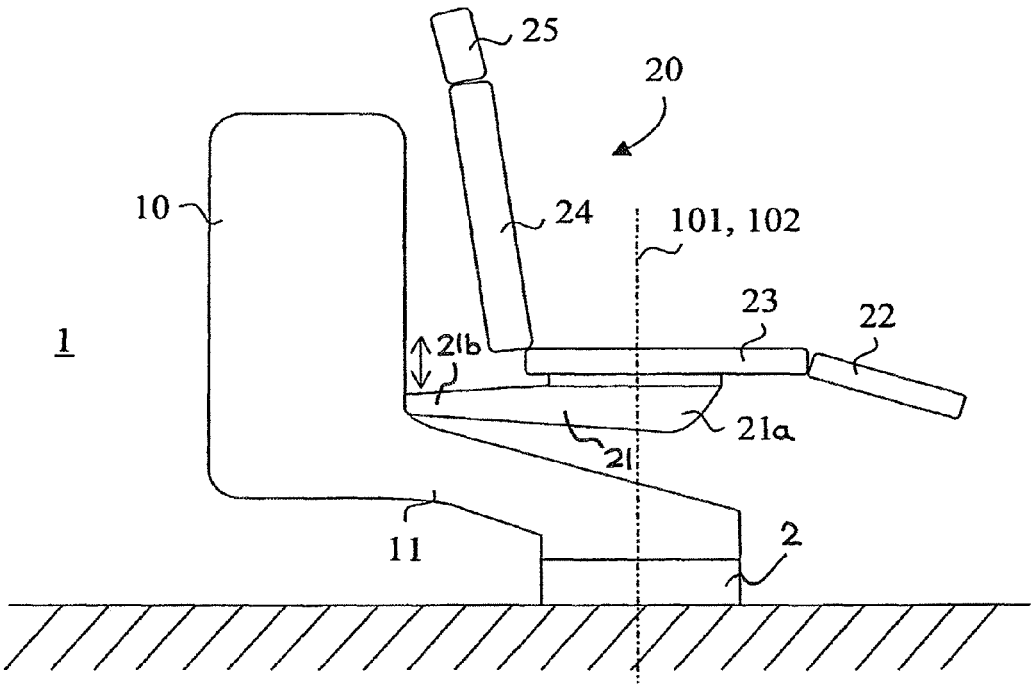
FIG. 1 represents the basic structure of a preferred embodiment of the apparatus of the invention in side view.

FIG. 1 presents in side view a basic structure of the integrated dental care apparatus 1 according to the invention. The apparatus according to FIG. 1 comprises a floor-mounted dental care unit 10 and a patient chair 20 arranged to be supported by a substantially horizontally extending arm part 21 connected to the dental care unit 10. The dental care unit 10 is mounted to the floor at its base 2. In the solution according to FIG. 1, the dental care unit 10 including a vertically extending part is likewise arranged to be supported by a substantially horizontally extending arm part 11, the base end of which being arranged in connection with the floor-mount structure of the dental care unit 10. According to the invention, both the patient chair 20 and the dental care unit 10 are arranged to be turnable relative to a vertical axis 101, 102. The dental care unit 10 may be arranged to be turnable through 360 degrees relative to the vertical axis 101, 102. In the solution illustrated in FIG. 1, the dental care unit 10 turns substantially along with its arm part 11 while the arm part turns substantially about a mounting point located at its base, whereas the patient chair 20 rotates substantially at a distal end 21*a* of its supporting arm 21, opposite its proximate end 21*b*, and at a location at a horizontal distance from the proximate end 21*b*. As this construction includes the floor mounted substantially horizontally extending arm part 21 which supports the dental care unit 10, the bottom of the vertical part of the dental care unit 10 stands at a distance from the floor level. In the construction of FIG. 1, the dental care unit 10 may be provided with means for raising and lowering the arm part 21 supporting the patient chair 20. However, support of the patient chair 20 and adjustment of its vertical position can also be implemented in other ways, e.g. by using a lever-arm type structure. Preferably at least part of the mechanics required for changing the height position of the patient chair 20 is arranged in connection with the dental care unit 10, though.

Figure 2:
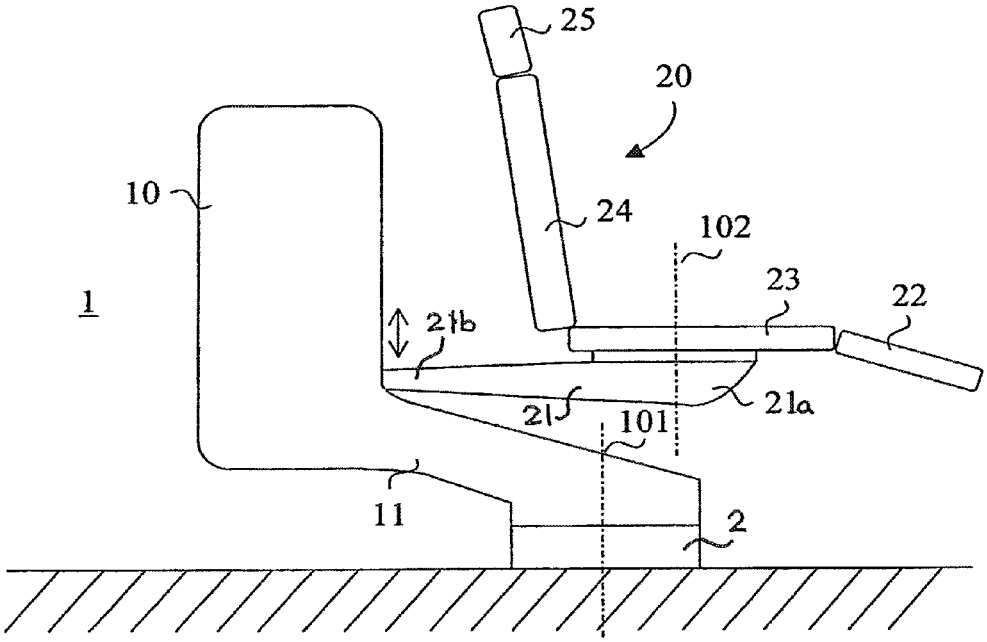
FIG. 2 represents the basic structure of a second preferred embodiment of the apparatus of the invention in side view.

In FIG. 1, the axes of rotation 101, 102 of the patient chair 20 and the dental care unit 10 are represented by a unified line to emphasize that in this embodiment of the invention, positions of said vertical axes 101, 102 unite. However, the construction according to the invention can also be implemented in such a manner that the vertical axis 101 relative to which the dental care unit 10, or as according to FIG. 1 that of the supporting arm 11 of the dental care unit 10, is arranged to be turnable and, on the other hand, the vertical axis 102 relative to which the patient chair 11 is arranged to be turnable, lie at a distance from each other (FIG. 2). Such an arrangement allows the position of the patient chair 20 to be changed in the dental treatment space even though the integrated dental care apparatus 1 itself is floor-mounted. This solution brings on certain additional features, out of which e.g. the one could be mentioned here that a shift in the mutual position of the parts of the construction from a left-handed person's working arrangement into a right-handed one and vice versa can be realized in a smaller space than what is possible as compared to the construction according to FIG. 1.

The rotation of the patient chair 20 relative to the dental care unit 10 can be implemented by a motorized technique. According to a preferred embodiment of the invention, the apparatus is provided with an arrangement enabling these two parts to be turned independently of each other, i.e. e.g. so that one of them is stationary while the other is moving. On the other hand, it is possible to provide e.g. the control system of the apparatus and its user interface with various automated functions for bringing the parts of the apparatus into given desired positions relative to each other. In addition to the parts already discussed, the above may also be arranged to apply to other parts that may be included in the apparatus. According to one preferable embodiment, the means for enabling the dental care unit 10 to be turned relative to a vertical axis 101, 102 are arranged substantially in connection with the means for mounting the dental care unit 10 on the floor. On the other hand, the means for enabling the patient chair 20 to be turned relative to a vertical axis 101, 102 may be arranged in connection with the means 21 for supporting the patient chair 20.

Figure 3:
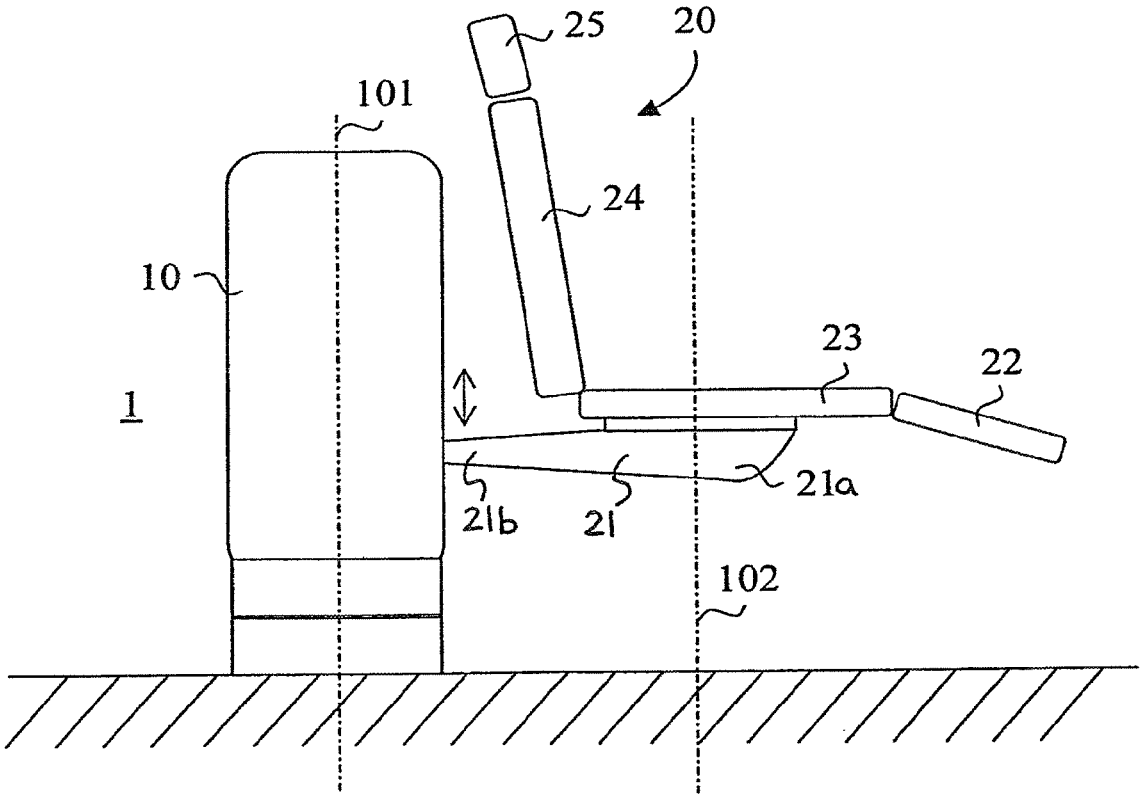
FIG. 3 represents a third embodiment of the apparatus of the invention in side view.

According to one embodiment of the invention, the actual dental care unit 10 is not arranged to be turnable at the end of a supporting arm 11 at a distance from the vertical axis 101 as in FIGS. 1 and 2 but is instead arranged to be turnable substantially in place, i.e. e.g. in such manner that the dental care unit 10 includes no substantially horizontally extending arm part 11 as described above at all but the aforesaid physical or virtual vertical axis 101 passes through the actual dental care unit 10 itself (FIG. 3). On the other hand, besides that the patient chair 20 may be arranged turnable substantially about itself, it may also or alternatively be arranged turnable as supported by its supporting arm 21, along with the rotating motion of the supporting arm 21.

In FIG. 1, the patient chair 20 is shown in a position where the backrest 24, which is functionally connected to the actual seat part 23 of the chair, has been raised to an upright position. According to one preferred embodiment of the invention, the dental care unit 10 is arranged to be turnable relative to the vertical axis 101 in such manner that, when the dental care unit 10 is being turned, it simultaneously moves along a circular path of a radius just barely sufficient to allow the dental care unit 10 to be turned to the other side of the patient chair 20 while the backrest 24, and with it the headrest 25 of the patient chair 20 are in an upright position (or in other words, to allow the patient chair 20 to be turned the other way round relative to the dental care unit 10). Turning of the patient chair 20 may be arranged through a part attached to the seat part 23 arranged to be turnable relative to a horizontal axis 101, 102.

Figure 4:
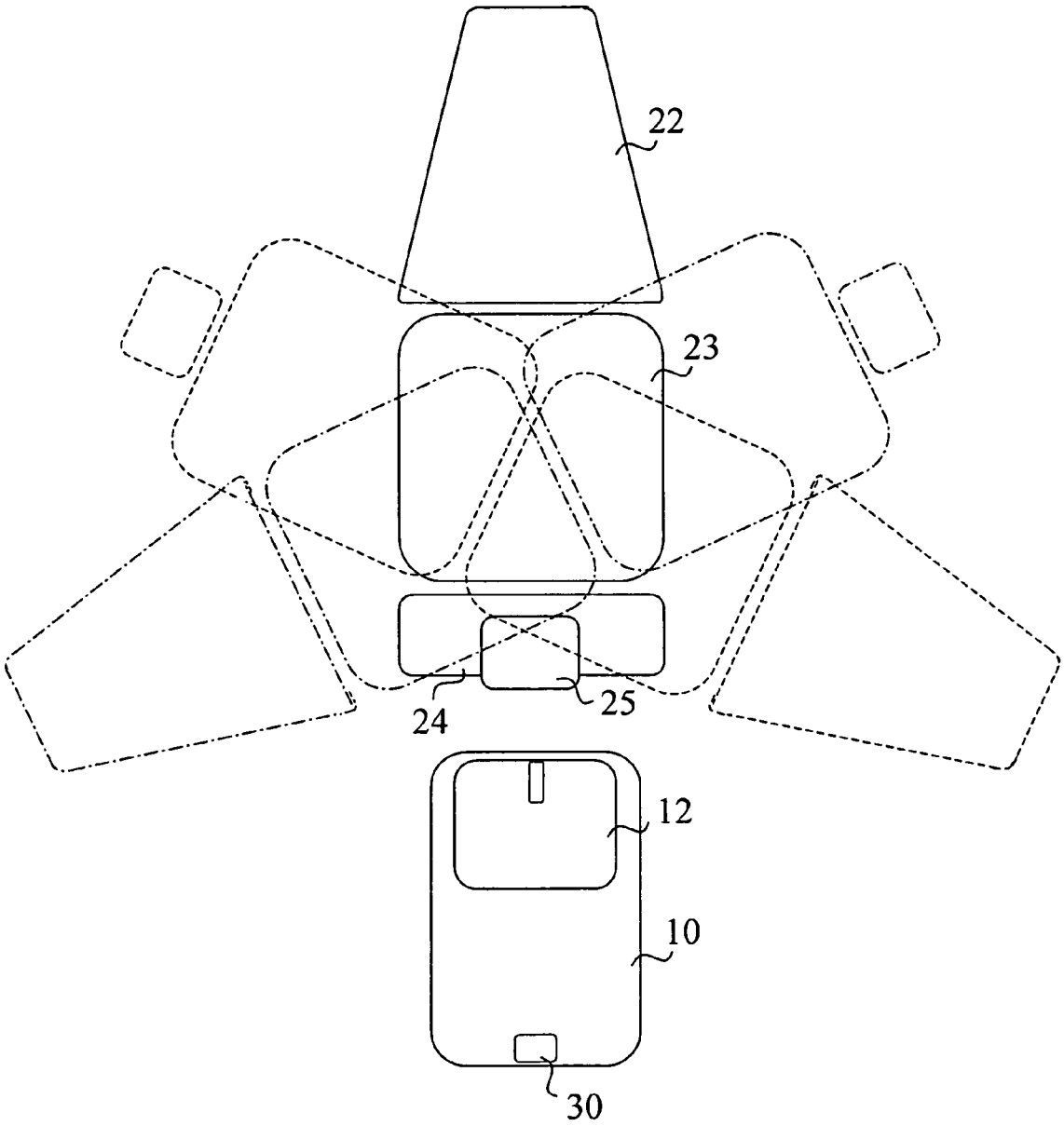
FIG. 4 shows some possible positions of the patient chair relative to the dental care unit.

According to the invention, the dental care unit 10 can in principle be arranged to turn around the patient chair 20 by the side of the footrest 22 of the chair 20 as well, e.g. by arranging the footrest. 22 to be turnable into a vertical position. However, the first-mentioned alternative enables a functionality wherein the patient is in a sitting position for consultation (FIG. 1) while the dental care unit 10 is out of sight behind the backrest 24 and, after the consultation, the dental care unit 10 and the patient chair 20 are moved into a desired relative position for treatment. FIG. 4 presents a top-view illustration of the relative location of the patient chair 20 and the dental care unit 10 in a consultation situation (solid lines), and placements of the patient chair 20 relative to the dental care unit 10 into right- and left-handed working positions (broken lines). To simplify the figure, the supporting arm 21 supporting the patient chair 20 is not shown in FIG. 4—and, its position being obvious to a skilled person, neither is it shown in the subsequent figures representing the apparatus in top view.

Figure 5:
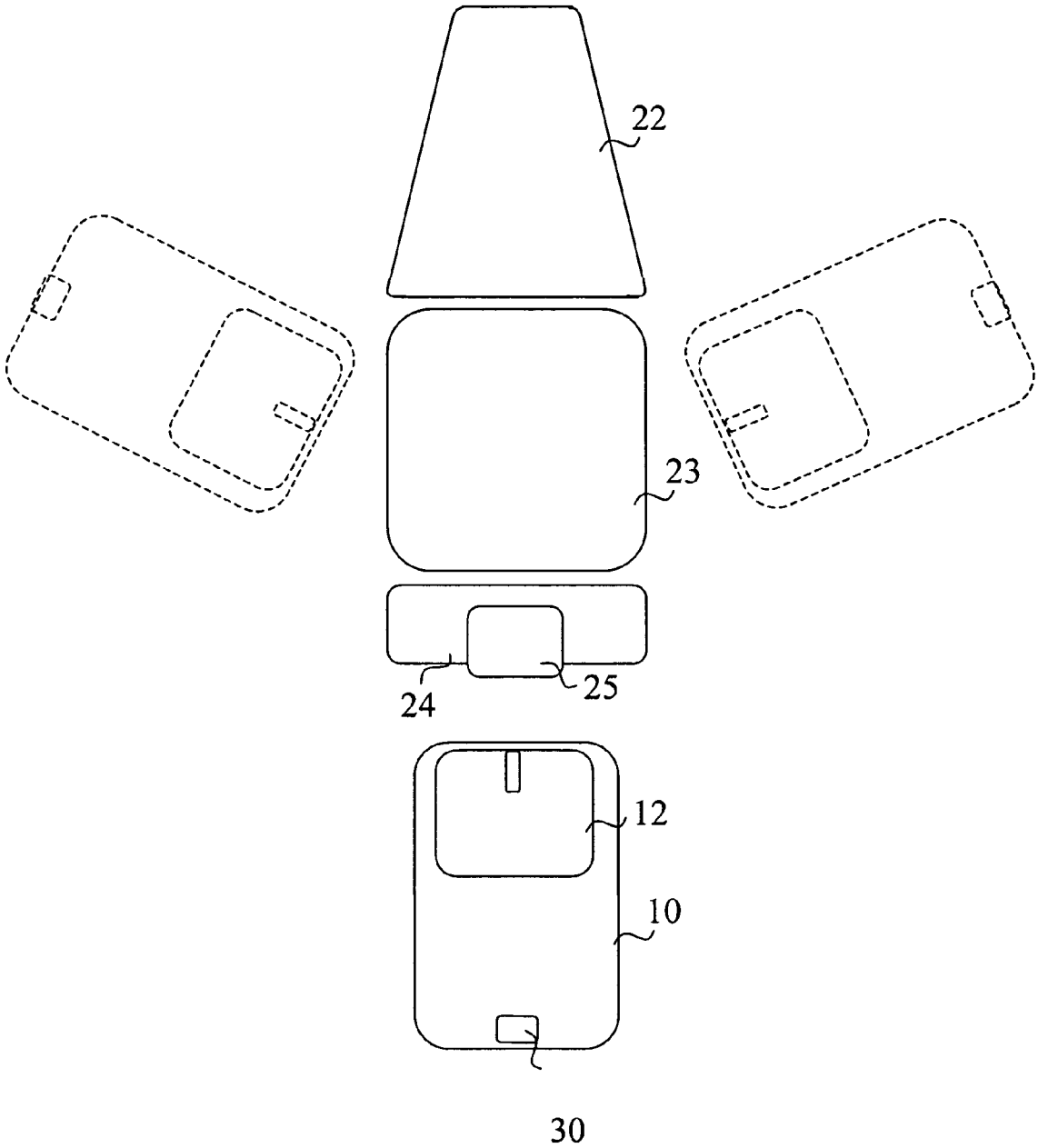
FIG. 5 shows some possible positions of the dental care unit relative to the patient chair.

FIG. 5 presents the relative positions of the patient chair 20 and the dental care unit 10 corresponding to FIG. 4, but from the point of view of how the position of the dental care unit 10 changes in relation to the patient chair 20 upon a change from the consultation position into right- and left-handed working positions.

In the above description, the dental care unit 10 and the patient chair 20 comprised in the integrated dental care apparatus have been considered, but besides a work post for the dentist, many modern integrated dental care apparatuses additionally comprise a work post for an assistant, which is typically located on the other side of the patient chair 20 relative to the dentist's work post—i.e. typically on that side of the patient chair 20 where the dental care unit 10 is located. In practice, the assistant's work post may consist of e.g. an instrument stand or unit separate from the dentist's instrument table and attached to the dental care unit e.g. via a hinged arm structure. The assistant's instrument stand or unit is typically arranged to be secured to an arm system allowing the instruments to be reached from the assistant's work post as well as from the dentist's work post—either by enabling the instrument stand or unit to be turned to the other side of the patient chair 20 by passing it under the patient chair 20, or by enabling reaching the stand over the patient chair 20. For example, the suction system of a dental care unit is often arranged at the assistant's work post.

Figure 6:
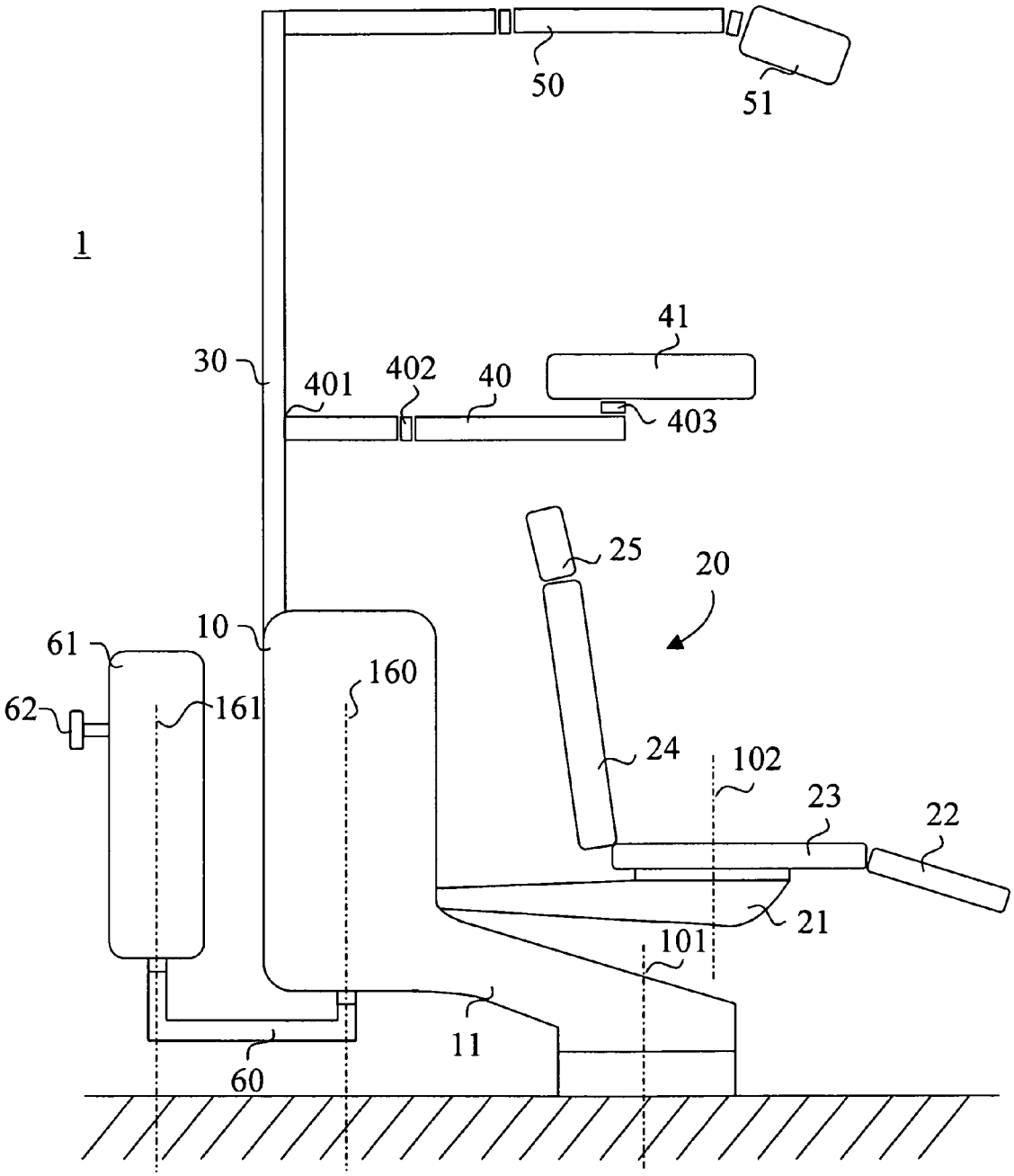
FIGS. 6 and 7 present in side view one preferred embodiment of the apparatus of the invention.
Figure 7:
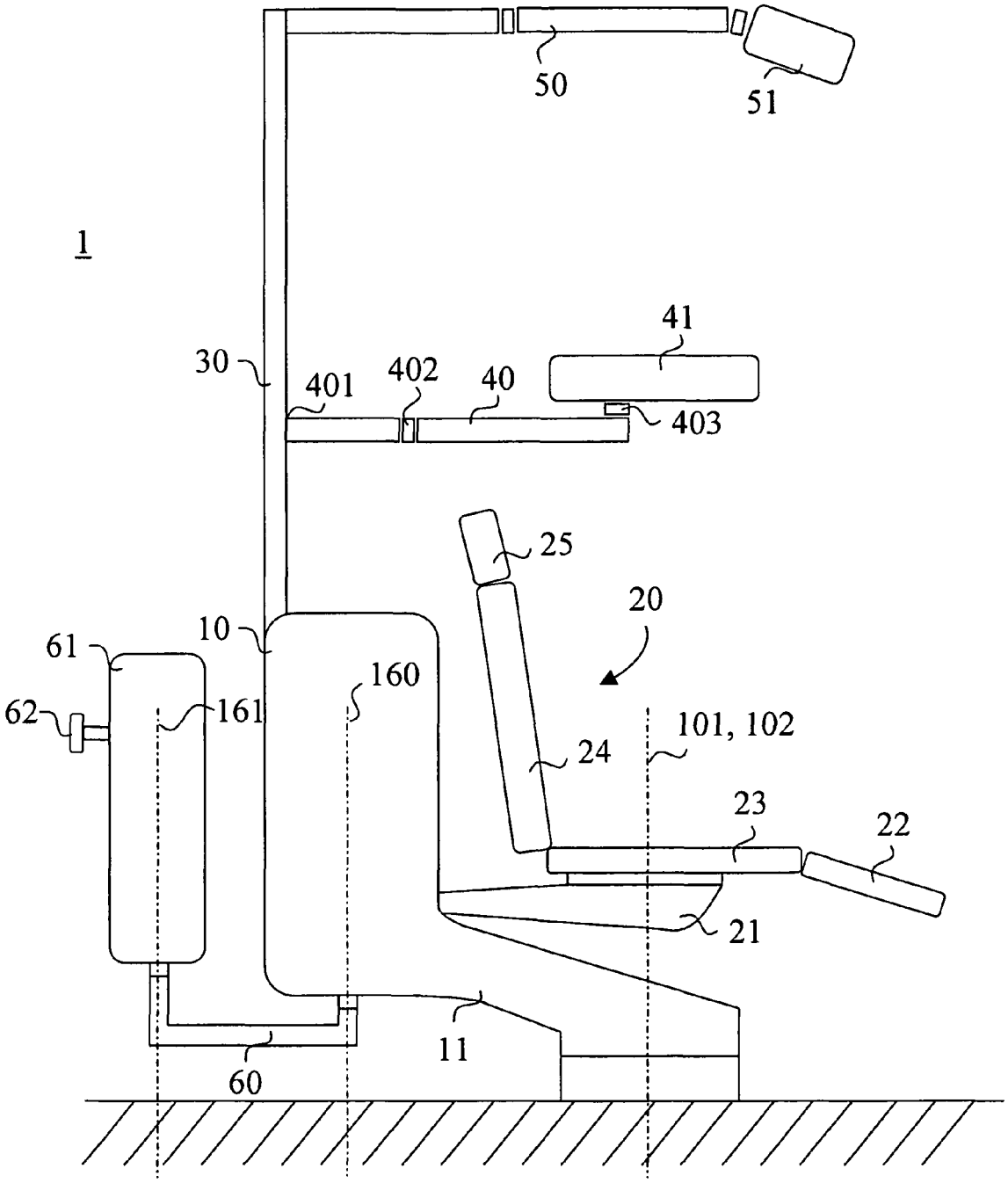

The arrangements presented in FIGS. 6 and 7 include one embodiment applicable in the invention for another instrument holder 62 to be provided in the integrated dental care apparatus 1. This solution comprises an articulated arm system 60 arranged to extend from the dental care unit 10, connected to the dental care unit 10 at its bottom, to support an assistant's unit 61. The assistant's unit 61 is arranged to be turnable relative to at least two vertical axes 160, 161 located at a distance from each other.

Thus, according to one, preferred embodiment of the invention, the instrument holder 62 forming an essential part of the assistant's work post is also arranged in connection with the dental care unit 10 in such manner that, when right-handed placement of the parts of the integrated dental care apparatus is changed to left-handed placement, the assistant's unit 61 including the instrument holder 62 can be turned into a corresponding position relative to the dental care unit 10 and the patient chair 20. According to a preferred embodiment, this is implemented firstly by using an arrangement where the assistant's unit 61 is mounted on an arm 60 extending substantially vertically to the dental care unit 10 from below the dental care unit 10, said arm 60 being turnable at its base relative to a vertical axis 160, so that the assistant's unit 61, too, is mounted on this arm 60 to allow the assistant's unit 61 to be turned in relation to a second vertical axis 161. Further, if the assistant's unit 61 is provided with an adjustably placeable instrument holder 62, then the position of the latter also has to be arranged to permit the holder 62 to be symmetrically placed relative to the assistant's unit 61. In addition to the right-left-handed property, such an arrangement also provides versatile possibilities for positioning the instrument holder 62 in connection with the assistant's work post itself.

In FIGS. 6 and 7, the assistant's unit 61 comprises of a vertical member, which is arranged in the arm 60 and which carries the instrument holder 62 for the assistant's instruments. This type of vertical member of the assistant's unit 61 is often arranged to form a part of the suction system of the integrated dental care apparatus. The vertical member of the assistant's unit 61 may be arranged to be turnable through 360 degrees relative to a vertical axis 161.

To enable the dentist's work post to be made identical on either side of the patient chair 20, it is necessary to consider, besides the patient chair 20 and the dental care unit 10, also other parts that may be included in the integrated dental care apparatus. For example, typically a spittoon arrangement 12 with a water tap and a cup stand is arranged in connection with the dental care unit 10 (FIG. 4). In a preferred embodiment of the invention, the spittoon arrangement 12 is also implemented in such manner that all its parts locate themselves or may be located in a corresponding manner from the user's point of view regardless of whether the dental care unit 10 is reviewed from the point of view of right-handed or left-handed work. For example, if location of the spittoon 12 is arranged to be variable, it may be arranged to be turnable symmetrically relative to the dental care unit 10, to either side of it.

Further, a modern integrated dental care apparatus typically also comprises at least one, often at least two arm structures 40, 50 attached to the dental care unit 10 to accommodate auxiliary equipment, such as an operating light 51 and e.g. instruments to be positioned on the instrument table 41 for use in dental work (FIG. 6). For example, in view of a consultation position of the apparatus, it is possible to provide the apparatus with an arm for a (computer) display screen.

Arms like those described above are typically attached to a column 30 extending vertically from the dental care unit 10. On the other hand, as not shown in the attached figures, especially an arm carrying an instrument table can also be arranged to be attached to the pedestal of the dental care unit 10, either to its immovable part fixedly mounted on the floor or to the part above it, i.e. to the part of the dental care unit 10 located under the patient chair 20 and turnable in relation to the aforesaid vertical axis 101.

According to one preferred embodiment of the invention, this kind of arm systems, especially the arm system 40 for instruments, are so implemented that the arm system can be positioned symmetrically relative to the patient chair 20 irrespective of on which side of the patient chair 20 the dental care unit 10 is located. For example, in the embodiment presented in FIG. 7, this has been realized by providing three swivel joints 401, 402, 403 in the instrument arm 40. Of these swivel joints, the first 401 enables the instrument arm 40 to be turned in a horizontal plane at its base, the second 402 bending of the arm in a horizontal plane and the third 403 turning of the instrument table 41, arranged at the end of the arm 40, in a horizontal plane. The height position of the instrument table 41 on the column 30 can be arranged to be adjustable, and likewise the instrument arm 40 can be provided with a joint (not shown in the figure) permitting adjustment of the height position of the instrument table 41.

The instrument table 41 or equivalent of the integrated dental care apparatus is typically arranged to hold several different instruments requiring different operating quantities. To allow instruments to be placed in a desired order on the instrument table 41, a solution known as such is to arrange at least some of the instrument places to be universal. According to one preferred embodiment of the invention, in order to enable the typical dental instruments to be arranged in a corresponding order irrespective of whether the instrument table 41 is positioned for right- or left-handed use, all the instrument places are arranged to be universal.

Correspondingly to what was said above regarding the instrument places of the instrument table 41, the assistant's work post, including the instrument holder 62 and instrument places used therein, is likewise preferably implemented so as to allow at least some of the instruments to be placed in the same way from the point of view of the user of the apparatus in both right-handed and left-handed situations.

Thus, according to a preferred embodiment of the invention, at least all those parts of the integrated dental care apparatus which are visible to the dentist and/or dental assistant are arranged to be positioned and used in such manner that the treatment work post can be arranged to be symmetrically identical on either side of the patient chair 20. One way of describing the invention is thus to define it as comprising an integrated dental care apparatus in which a patient chair 20 and a dental care unit 10 are arranged to be substantially symmetrical and the patient chair 20 is arranged to be turnable relative to the dental care unit 10 about an axis 101, 102 arranged in the plane of symmetry of the dental care unit 10, and in which preferably also the other parts of the apparatus, such as the structures supporting the dentist's and assistant's instruments, the operating light etc., are arranged to be turnable relative to an axis arranged in the plane of symmetry of the dental care unit 10.

The integrated dental care apparatus of the invention can also be described as comprising a patient chair 20 and a dental care unit 10, in which apparatus at least one of the following is structurally connected to the dental care unit: a spittoon arrangement 12, an arm 40 for dentist's instruments, an arm 60 for assistant's instruments and/or for a suctions system of the integrated dental care apparatus, an arm for a display screen, an arm 50 for a light 51, an arm arranged for some other device used in a dental care environment, a connector structure for any device used in a dental care environment, whether mentioned above or not, and in which the integrated dental care apparatus is arranged to comprise means for mounting it on a floor and the dental care unit 10 and patient chair 20 are structurally connected by means supporting the patient chair 20 at least. Further, the apparatus may be implemented by arranging said dental care unit 10 to be symmetrical at least as far as the external parts visible to the dental treatment site are concerned, to form at least one vertical plane of symmetry, with which plane of symmetry being arranged to unite at least the axis 101, 102 relative to which the arm 40, 60 for assistant's instruments and/or dentist's instruments is arranged to be turnable, and further said patient chair 20 being arranged to be symmetrical at least as far as its external parts are concerned to form at least one vertical plane of symmetry, with which plane of symmetry the axis 101, 102 relative to which said dental care unit 10 has been arranged to be turnable is arranged to unite.

Further, the apparatus of the invention may comprise an assistant's unit 61 arranged to comprise at least one plane of symmetry at least in respect of its external parts, which unit 61 is located in connection with the aforesaid arm 60 for assistant's instruments and comprises at least one instrument holder 62 provided for said assistant's instruments, the position of said instrument holder 62 being arranged to be adjustable relative to an axis 161 uniting with at least one of the aforesaid at least one plane of symmetry. The apparatus may also comprise one, two or more substantially horizontally extending arm structures 40, 50, 60 which are arranged to support instruments or devices used in connection with dental care work and which are arranged to comprise at least one such articulated shaft which unite with the aforesaid plane of symmetry of the dental care unit 10. The dental care unit 10 may also comprise a spittoon arrangement 12 which itself or at least some of the components comprised in it is/are arranged to be adjustable in position so that it or they is/are turnable relative to an axis uniting with the aforesaid plane of symmetry of the dental care unit 10.

The invention and its various embodiments make it possible, among other things, to implement a common dental practice for a right-handed and a left-handed dentist using the same integrated dental care apparatus. Further, in the case of possible resale of the apparatus or practice, the invention makes it irrelevant to consider whether the previous and future users of the apparatus are of the same or different handedness. The movements of the parts of the apparatus can be arranged to be motorized or manual as desirable, e.g. according to how frequently each re-positioning of the parts of the apparatus is likely to be done at the practice.

Figure 8A:
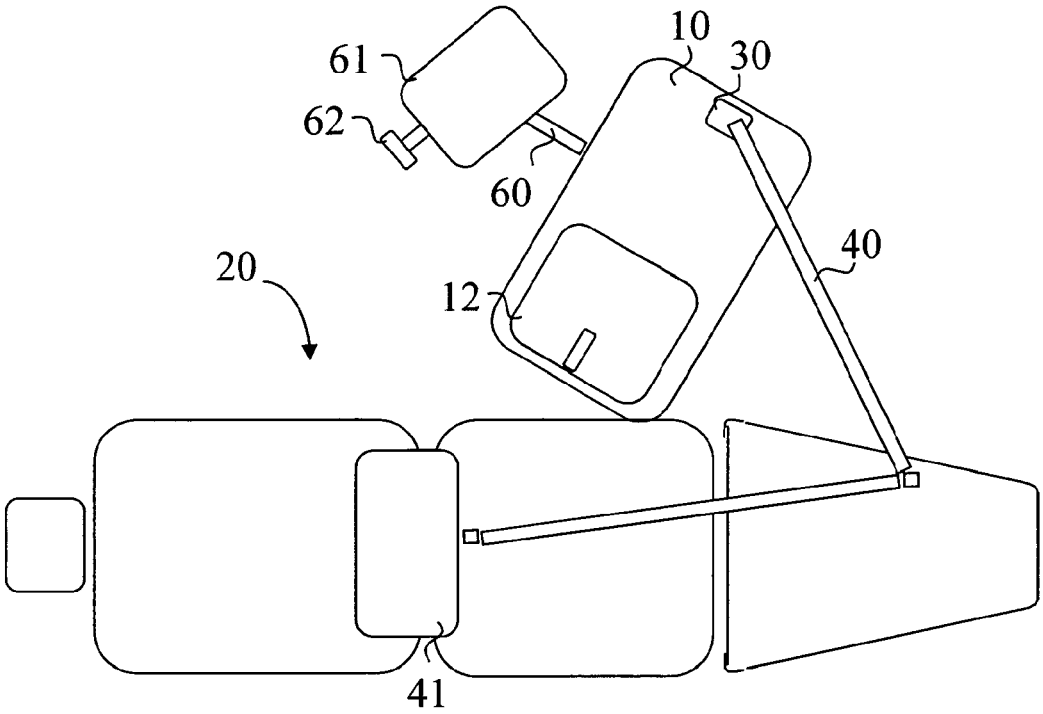
FIG. 8A represents the apparatus of the invention as seen from above, positioned for right-handed work.
Figure 8B:
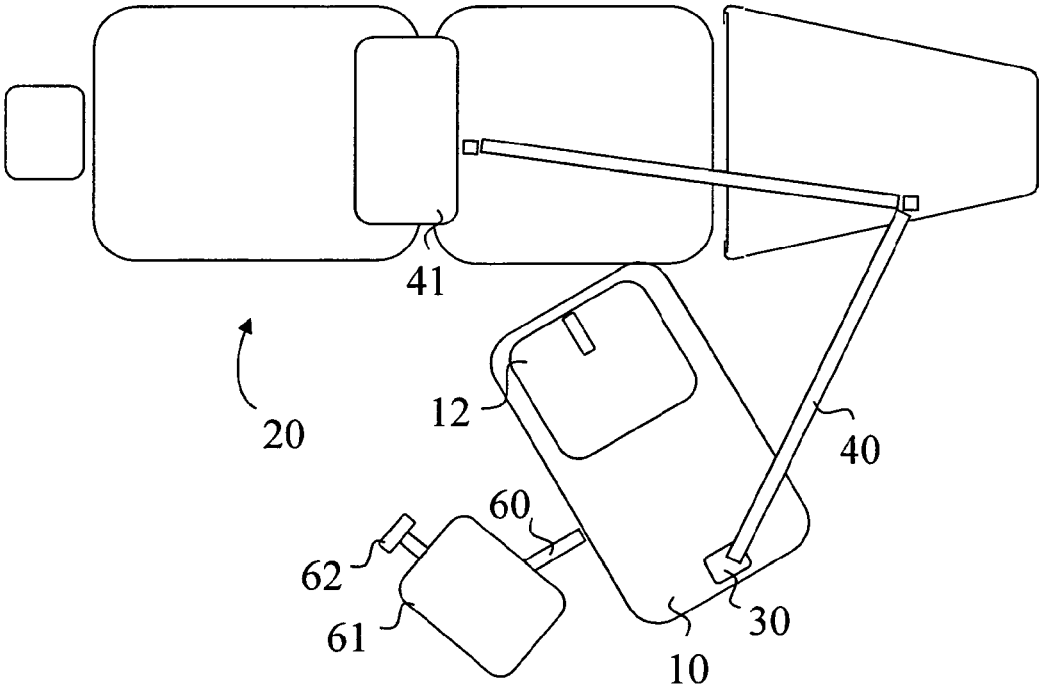
FIG. 8B represents the apparatus of the invention as seen from above, positioned for left-handed work.
Figure 9:
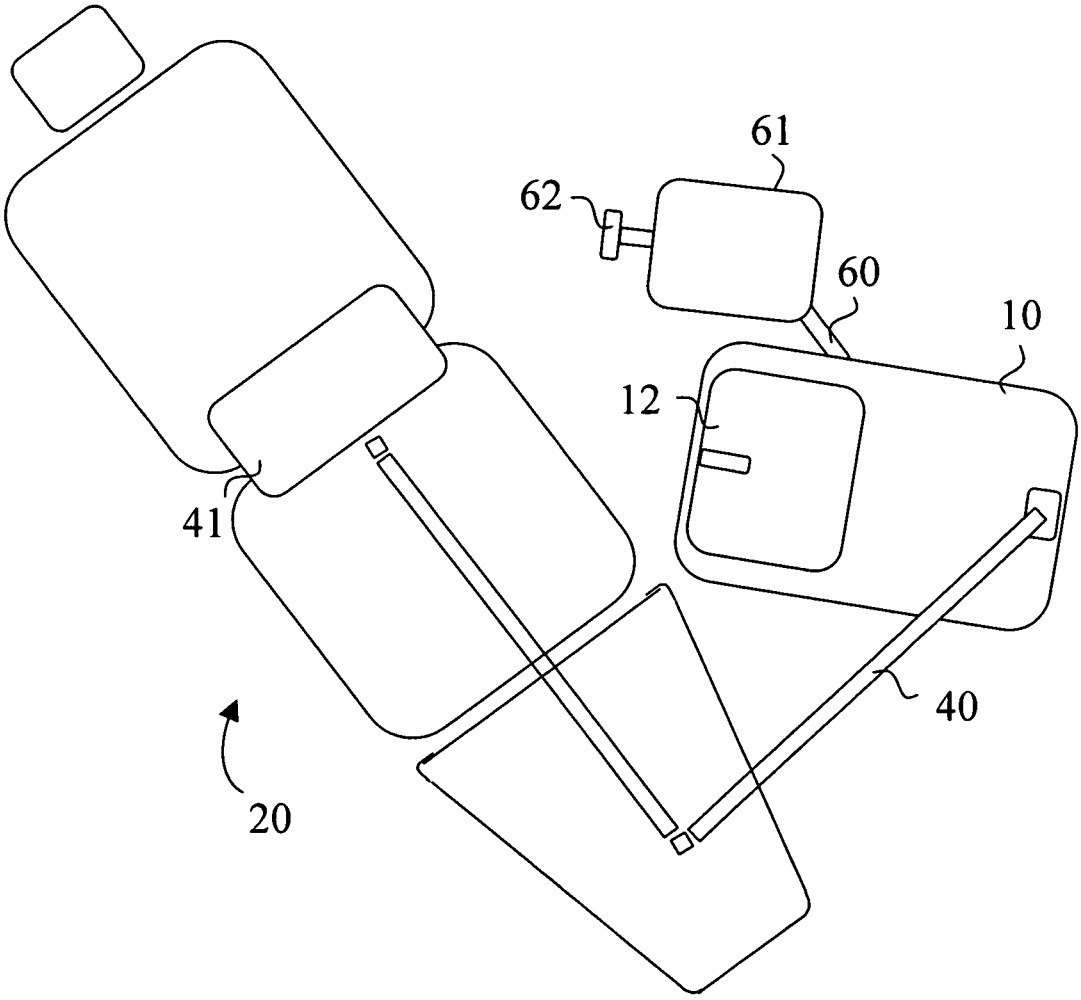
FIG. 9 illustrates one possible way of positioning the components of the apparatus according to FIG. 6 in the working space.

One preferred embodiment of the invention comprises a possibility to turn the patient chair 20 through 180 degrees (at least) with respect to the dental care unit 10. When this is combined with that preferred embodiment of the invention wherein the vertical axes 101, 102 relative to which the patient chair 20 and the dental care unit 10 are arranged to be turnable lie at a distance from one other, the apparatus makes it possible to achieve versatile and completely new kinds of possibilities for placement of parts of an integrated dental care apparatus in which the patient chair 20 and the dental care unit 10 are integrated to a single assembly. For example, FIGS. 8A and 8B visualizes how the dental care unit 10 and the patient chair 20 can be arranged in turned positions with respect to each other, thus modifying the space available at the assistant's work post. The patient can be positioned in different orientations in the treatment space and e.g. moved closer to a given wall, cupboard or the like in the treatment space if necessary, in other words, brought to a closer or more ergonomic position in relation to e.g. a wall-mounted dental X-ray apparatus or other piece of auxiliary equipment, such as a light, microscope, monitor, camera, etc. The fact that the patient can be positioned in relation to a piece of auxiliary equipment allows in principle the arm systems for the auxiliary equipment to be implemented in a simpler form than before. On the other hand, the apparatus of the invention provides more possibilities regarding positioning of additional equipment in the treatment space because such equipment need not be so carefully located but the patient can be brought to a position within reach of such equipment.

Regarding the invention and its preferred embodiments, it is further worth mentioning that, as the various objects and cupboards in the treatment room are typically located in predetermined places, the invention provides the possibility that, when the dentist is working alone/with an assistant, the position of the patient chair 20 can be changed somewhat so that when working alone the dentist is able to reach the cupboards on the assistant's side—whereas when an assistant is present, the assistant serves the dentist from his/her own side and extends articles from that side to the dentist.

Furthermore, the invention makes it possible to optimize the assistant's working space by moving the dental care unit 10 as far from the assistant as possible and, on the other hand, to move it closer e.g. when the patient needs to reach to the spittoon 12. The dental care unit 10 can also be brought closer to the patient chair 20 when the assistant leaves the work post to attend to other tasks, and thus the dentist is better able to reach e.g. to the spittoon 12, a cup and the instruments placed on the assistant's instrument holder 62.

An essential feature of the preferred embodiments of the invention is that the axes of rotation of rotatable parts of the apparatus are arranged in an appropriate manner in the plane of symmetry of at least one other part of the apparatus, and it is possible to provide several separate planes of symmetry in the apparatus.

The instrument table or holder used in the integrated dental care apparatus may comprise at least two such instrument connection places, arranged especially in the corners of the instrument table, whereto a spray instrument can be placed symmetrically. The apparatus of the invention may also comprise symmetrically arranged connection places e.g. for a display screen or graphic user interface.

In one preferred embodiment, the horizontal dimension of the means 21 for supporting the patient chair 20 is substantially of the same order of magnitude as the horizontal dimension of the horizontally extending part 11 of the support structure for the dental care unit 10. In such context, a preferable distance between the vertical axes 101, 102 relative to which the patient chair 20 and the dental care unit 10 are arranged turnable is of the order of 200 mm or less.

Yet further embodiments of the invention are evident to a man skilled in the art within the scope of the following claims.

The invention claimed is:

1. An integrated dental care apparatus, said apparatus comprising:

a base adapted to be mounted to a floor;

a dental care unit, said dental care unit being rotatably mounted to the base for rotation relative to a first vertical axis;

at least one device structurally connected to the dental care unit selected from the group consisting of:

a spittoon arrangement, an arm for dentist's instruments, an arm for assistant's instruments and/or for a suction system, an arm for a display screen, an arm for a light, an arm for a tray, an arm for some other implement used in a dental treatment environment, and a connector structure for a device or implement used in a dental treatment environment;

a substantially horizontally extending support structure attached to the dental care unit at a proximate end of the support structure and extending substantially horizontally from the dental care unit to a distal end of the support structure; and a patient chair rotatably mounted to the support structure at a location at a first horizontal distance from the proximate end of the structure, said chair being rotatable relative to a second vertical axis.

2. The integrated dental care apparatus according to claim 1, further comprising a mechanism for changing a height position of the patient chair by raising and lowering the patient chair, and wherein at least part of mechanism is arranged in the dental care unit.

3. The integrated dental care apparatus according to claim 1, wherein the dental care unit and the patient chair are arranged to be turnable relative to each other in such manner that the dental care unit may be positioned symmetrically in relation to the patient chair into at least one position on either side of the patient chair.

4. The integrated dental care apparatus according to claim 1, wherein the dental care unit comprises a vertically-extending portion and a substantially horizontally-extending portion extending substantially horizontally from a first end integrated with a lower end of the vertically extending portion to a second end integrated with the base such that the vertically extending portion is separated from the base by a second horizontal distance.

5. The integrated dental care apparatus according to claim 4, wherein a horizontal dimension of the support structure is substantially of a same order as a horizontal dimension of the substantially horizontally extending portion of the dental care unit.

6. The integrated dental care apparatus according to claim 4, wherein the vertically-extending portion and the substantially horizontally extending portion of the dental care unit are implemented in such manner that while the base to which the dental care unit is mounted is mounted on the floor, at least part of the bottom of the vertically-extending portion stands at a distance from a floor level.

7. The integrated dental care apparatus according to claim 1, further comprising means for enabling the dental care unit to be turned relative to the first vertical axis arranged substantially in connection with the base.

8. The integrated dental care apparatus according to claim 1, wherein the dental care unit is turnable through 360 degrees relative to the first vertical axis.

9. The integrated dental care apparatus according to claim 1, further comprising means for enabling the patient chair to be turned relative to the second vertical axis connectively associated with the distal end of the horizontally extending support structure.

10. The integrated dental care apparatus according to claim 1, wherein the patient chair is arranged to be turnable through at least 180 degrees relative to the second vertical axis.

11. The integrated dental care apparatus according to claim 1, further comprising a swivellably mounted arm for dentist's instruments connected to the dental care unit, the swivellably mounted arm comprising an instrument table or equivalent means for supporting the dentist's instruments and means for swiveling the arm relative to at least third and fourth vertical axes located at a distance from each other.

12. The integrated dental care apparatus according to claim 11, wherein the instrument table or equivalent means for supporting the dentist's instruments is arranged to be turnable relative to a fifth vertical axis.

13. The integrated dental care apparatus according to claim 1, further comprising an arm for assistant's instruments and/or for a suction system of the integrated dental care apparatus, said arm being arranged in the dental care unit so as to be turnable relative to a third vertical axis.

14. The integrated dental care apparatus according to claim 13, wherein the arm for the assistant's instruments and/or for the suction system of the integrated dental care apparatus comprises a substantially vertical member, which comprises means for supporting instruments and which is arranged in the arm to enable the substantially vertical member to be turned relative to a fourth vertical axis.

15. The integrated dental care apparatus according to claim 14, wherein the vertical member arranged in the aforesaid arm for the assistant's instruments and/or for the suction system of the integrated dental care apparatus is arranged to be turnable through 360 degrees relative to the fourth vertical axis.

16. The integrated dental care apparatus according to claim 1, wherein the arm for the assistant's instruments and/or for the suction system of the integrated dental care apparatus is connected to the dental care unit from a bottom of the dental care unit.

17. The integrated dental care apparatus according to claim 1, further comprising a spittoon arrangement attached to the dental care unit and turnable relative to a third vertical axis.

18. The integrated dental care apparatus according to claim 1, wherein the patient chair comprises a seat part, and at least one part attached to the seat part such that the patient chair is turnable relative to a horizontal axis.

19. The integrated dental care apparatus according to claim 1, wherein the dental care unit comprises an exterior surface having a plane of symmetry, and the second vertical axis upon which the patient chair is turnable is located in this plane of symmetry.

20. The integrated dental care apparatus according to claim 1, wherein the dental care unit comprises an exterior surface having a plane of symmetry and wherein the at least one device structurally connected to the dental care unit is arranged to be turnable relative to a third vertical axis located in the plane of symmetry.

21. The integrated dental care apparatus according to claim 1, wherein at least some parts of the integrated dental care apparatus are arranged to be turnable independently in relation to other parts of the integrated dental care apparatus regardless of their position and/or of movement thereof.

22. The integrated dental care apparatus according to claim 1, wherein the dental care unit and the patient chair are arranged to be turnable independently of each other.

23. The integrated dental care apparatus according to claim 1, wherein the first vertical axis relative to which the dental care unit is arranged to be turnable, and the second vertical axis relative to which the patient chair is arranged to be turnable, are separated by a distance from each other.

24. An integrated dental care apparatus, said apparatus comprising:

a dental care unit mounted to a floor;

at least one device structurally connected to the dental care unit selected from the group consisting of:

a spittoon arrangement, an arm for dentist's instruments, an arm for assistant's instruments and/or for a suction system, an arm for a display screen, an arm for a light, an arm for a tray, an arm for some other implement used in a dental treatment environment, and a connector structure for any device or implement used in a dental treatment environment;

a substantially horizontally extending support structure attached to the dental care unit at a proximate end of the support structure and extending substantially horizontally away from the dental care unit to a distal end of the support structure opposite the proximate end; and a patient chair mounted to the support structure at a location that is separated by a horizontal distance from the proximate end of the support structure, wherein the at least one device structurally connected to the dental care unit includes an arm for assistant's instruments and/or dentist's instruments that is arranged to be turnable relative to a first axis, wherein said dental care unit is symmetrical at least with regard to external parts of the dental care unit visible when viewing the dental care unit to form a first vertical plane of symmetry, and the first plane of symmetry is united with the first axis relative to which the arm for assistant's instruments and/or dentist's instruments is turnable, and wherein the dental care unit is turnable relative to a second axis and said patient chair is symmetrical at least with regard to external parts of the chair to form a second vertical plane of symmetry, the second plane of symmetry uniting with the second axis relative to which said dental care unit is turnable.

25. The integrated dental care apparatus according to claim 24, comprising an assistant's unit having at least one plane of symmetry, at least with respect to external parts of the assistant's unit, which unit is located in connection with the arm and comprises at least one instrument holder provided for holding assistant's instruments, the position of the instrument holder being arranged to be adjustable relative to an axis uniting with at least one of the at least one plane of symmetry.

26. The integrated dental care apparatus according to claim 24, wherein the apparatus comprises two or more substantially horizontally extending arm structures, which are arranged to support instruments or devices used in connection with dental care work and which are arranged to comprise at least one such-axis with which the plane of symmetry of the dental care unit unites.

27. The integrated dental care apparatus according to claim 24, further comprising a spittoon arrangement which is or at least some components thereof are arranged to be adjustable in position so that the spittoon arrangement or said components are turnable relative to an axis uniting with the plane of symmetry of the dental care unit.

* * * * *